United States Patent [19]

McGuire

[11] 4,119,819

[45] Oct. 10, 1978

[54] FLUID ACTIVATED VELOCITY SWITCH

[75] Inventor: Charles H. McGuire, Scottsdale, Ariz.

[73] Assignee: Motorola Inc., Schaumburg, Ill.

[21] Appl. No.: 763,951

[22] Filed: Jan. 31, 1977

[51] Int. Cl.[2] ..... H01H 35/24

[52] U.S. Cl. ..... 200/81.9 R; 73/521; 200/61.46

[58] Field of Search ..... 200/61.44, 61.46, 81 R, 200/81.9 R, 153 N, 153 T, DIG. 32; 73/521

[56] References Cited

U.S. PATENT DOCUMENTS

| | | | |
|---|---|---|---|
| 2,747,699 | 5/1956 | Lucien | 200/61.46 |
| 3,492,451 | 1/1970 | Ponterio | 200/81.9 R |
| 3,501,605 | 3/1970 | Hutchinson | 200/81.9 R |

*Primary Examiner*—Gerald P. Tolin

*Attorney, Agent, or Firm*—Eugene A. Parsons

[57] ABSTRACT

A member mounted for limited rotation having a conduit coaxially connected to the member for directing a stream of air to the member, which stream is deflected radially outwardly and tangentially away from the member to cause rotation in a first direction, a spring connected to said member for biasing the member toward a quiescent position, and a device affixed to the member for actuating remote apparatus upon a predetermined amount of rotation of said member.

3 Claims, 2 Drawing Figures

FLUID ACTIVATED VELOCITY SWITCH

BACKGROUND OF THE INVENTION

In many instances it is desirable to actuate apparatus on a vehicle when the velocity of the vehicle reaches a predetermined value. If the vehicle is traveling through a fluid, such as air or water, the velocity of the fluid passed the surfaces of the vehicle may provide an indication of the velocity of the vehicle. If the velocity of the vehicle is high relative to the velocity of any disturbances in the fluid, the velocity of the fluid passed the surfaces of the vehicle is generally proportional to the velocity of the vehicle.

In the prior art, pitot tubes are used to provide an indication of the velocity of the fluid flowing past the vehicle and hoses are attached to the pitot tube and to a diaphragm activated switch. However, diaphragm actuated switches are relatively complicated to manufacture and are prone to receive dirt, bugs and the like therein which reduce the reliability thereof.

SUMMARY OF THE INVENTION

The present invention pertains to a velocity switch including a member mounted for limited movement in communication with means for receiving a stream of fluid, the stream of fluid being directed to cause movement of said member in a first direction, biasing means connected to said member for biasing the movement of said member in an opposite direction to the first direction and toward a quiescent position, and actuating means connected to said member for actuating remote apparatus upon a predetermined amount of movement of said member.

It is an object of the present invention to provide an improved velocity switch.

It is a further object of the present invention to provide a velocity switch which is relatively simple and cheap to manufacture and which is insensitive to dirt, bugs and the like.

These and other objects of the present invention will become apparent to those skilled in the art upon consideration of the accompanying specification, claims, and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
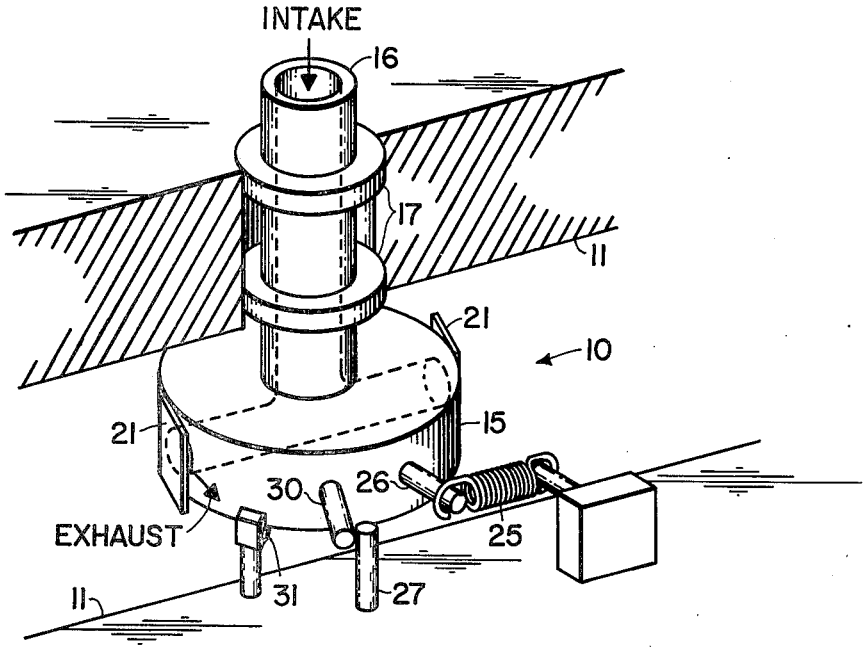
FIG. 1 is a view in perspective of a velocity switch embodying the present invention.

Referring to the Figures, a velocity switch generally designated 10 is adapted to be mounted on a vehicle 11, which vehicle 11 is illustrated schematically as the base member or ground plane to which some of the components are attached. The velocity switch 10 includes a member 15, which is generally disc shaped in this embodiment, having a conduit 16 coaxially attached thereto. The conduit 16 and disc member 15 are mounted for rotational movement by any convenient means, such as for example bearings 17. The bearings 17 and vehicle 11 are illustrated in very schematic form to simplify the drawing, since the apparatus for mounting the switch 10 may vary radically and is not a portion of this invention.

Figure 2:
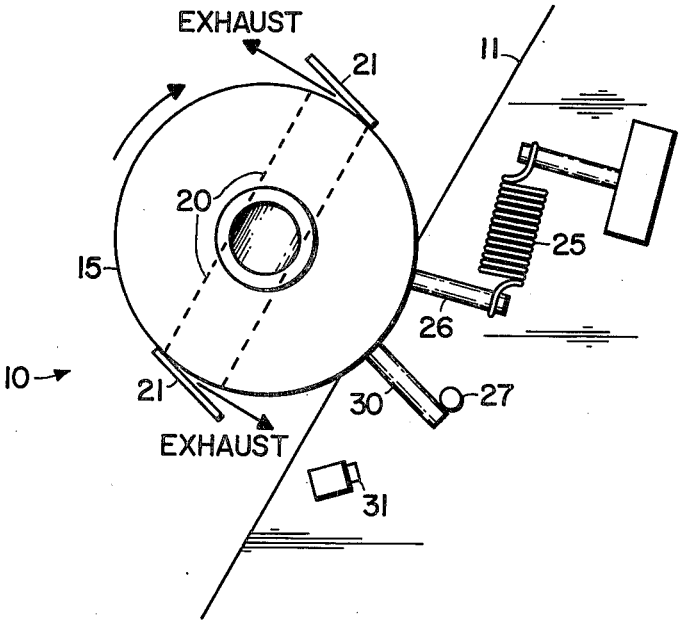
FIG. 2 is a view in top plan of the velocity switch illustrated in FIG. 1.

The disc 15 has one or more passageways 20 (2 in this disclosure) formed therein, which are in communication with the conduit 16 and extend radially outwardly to the outer periphery of the disc 15. The passageways 20 conduct fluid from the conduit 16 radially outwardly to the outer periphery of the disc 15. A blade 21 is affixed to the outer periphery of the disc 15 adjacent the opening of each of the passageways 20 so as to direct fluid flowing from the passageway 20 in a generally tangential direction to the outer periphery of the disc 15. It should be understood that the disc 15 might be formed with the blades 21 as an integral portion thereof but the present embodiment is illustrated because of its simplicity of construction. Thus, fluid flowing into the conduit 16 is directed radially outwardly in the disc 15 and is then redirected by the blades 21 in a direction tangential to the outer periphery of the disc 15, which causes rotation of the disc 15 in a first direction (clockwise in FIG. 2).

A spring 25 is fixedly attached at one end to the vehicle 11 and is attached at the other end to a peg 26 affixed to the disc 15. The spring 25 is mounted so as to bias the disc 15 against rotation produced by fluid flowing therethrough. The spring 25 biases the disc 15 toward the quiescent position, i.e., it tends to rotate the disc 15 toward the quiescent position when the velocity of fluid flowing through the disc 15 is reduced. A stop 27 is fixedly attached to the vehicle 11 so as to engage the peg 26 and limit rotation of the disc 15. Thus, the angular displacement of the disc 15 is proportional to the velocity of fluid flowing over the blades 21.

Since the angular displacement of the disc 15 is propotional to the air velocity flowing over the blades 21, the velocity switch 10 can be utilized to actuate remote apparatus in a variety of ways. In the present embodiment an actuating member, such as peg 30 is affixed to the outer periphery of the disc 15 and a switch 31 is fixedly attached to the vehicle 11 in the path of the peg 30 so as to be engaged thereby upon a predetermined amount of rotation of the disc 15. In this manner the switch 31 will be actuated upon a predetermined angular displacement of the disc 15 and, hence, a predetermined velocity of fluid flowing over the blades 21. Many other types of pick-offs might be utilized to indicate the angular displacment of disc 15, such as optical pick-offs, electric (magnetic) pick-offs, etc. Also, a continuous indication of the angular displacement of the disc 15 may be provided if desired by connecting a potentiometer to the disc 15 so that the angular displacement thereof altered the value of the potentiometer. The potentiometer can then be used to actuate remote apparatus upon predetermined amounts of movement of the disc 15.

It should be understood that many other configurations of the disc member 15 may be devised by those skilled in the art and many other types of bias, or springs, may be utilized to bias the moveable member toward the quiescent position and alter the proportionality of the angular displacement to the fluid velocity. The particular embodiment of the invention illustrated in the Figures is utilized because of its simplicity of construction and explanation as well as its value in creating a better understanding of the operation of the invention. Because the fluid utilized to operate the velocity switch travels directly through the switch, there is little chance of an accumulation of dirt or the like in the switch and, consequently, the switch is relatively insensitive to dirt, bugs and the like. Further, no complicated diaphragm actuated switches are required and all of the parts are relatively simple to adjust, replace, or otherwise maintain. Accordingly, an improved velocity switch is illustrated and described which is simpler and cheaper to manufacture than prior art velocity switches and which is much more versatile than prior art velocity switches.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claim is:

1. Apparatus for providing switching action including a member mounted for limited rotation about an axis in communication with means including a conduit with a longitudinal dimension extending along the axis for receiving a stream of fluid flowing in the longitudinal direction, means affixed to said member in fluid receiving communication with said conduit for receiving the fluid from said conduit and directing the fluid radially outwardly from the rotational axis and in a generally tangential direction to said member to cause rotation of said member in a first direction, biasing means connected to said member for biasing the rotation of said member in an opposite direction to the first direction and toward a quiescent position, and actuating means connected to said member for actuating remote apparatus upon a predetermined amount of rotation of said member.

2. Apparatus as claimed in claim 1 wherein the fluid is a medium suspending a vehicle on which the velocity switch is mounted and the predetermined amount of rotation indicates a predetermined velocity of the device.

3. Apparatus for providing switching action comprising:

(a) a member mounted for limited rotation about an axis;

(b) fluid inlet means connected to said member for supplying a stream of fluid thereto generally along the axis thereof;

(c) generally radical passageway means in said member and in communication with the stream of fluid for directing the stream of fluid generally radially outwardly from the axis of said member;

(d) spring means connected to said member for limiting the rotation thereof and biasing said member in a first direction;

(e) fluid diverting means affixed to said member adjacent the outer periphery thereof and in communication with said passageway means for diverting fluid exiting from said passageway means generally tangentially to the periphery of said member to cause rotation of said member in a direction opposite to the first direction; and (f) actuating means connected to said member for actuating remote apparatus upon a predetermined amount of rotation of said member.

* * * * *